US008998592B2

(12) United States Patent
Kurita et al.

(10) Patent No.: US 8,998,592 B2
(45) Date of Patent: Apr. 7, 2015

(54) COMPRESSOR

(71) Applicants: Kabushiki Kaisha Toyota Jidoshokki, Aichi-ken (JP); Tokyu Co., Ltd., Aichi-ken (JP)

(72) Inventors: Hajime Kurita, Kariya (JP); Masakazu Obayashi, Kariya (JP); Masahiro Hamanaka, Kariya (JP); Masakazu Hashimoto, Aichi-ken (JP); Takayuki Inoue, Aichi-ken (JP); Katsuji Abe, Aichi-ken (JP); Fumitaka Yoshizumi, Nisshin (JP); Masakatsu Kuroishi, Seto (JP); Yasuhiro Kondoh, Nisshin (JP); Kazunori Yoshida, Nagoya (JP)

(73) Assignees: Kabushiki Kaisha Toyota Jidoshokki, Aichi-Ken (JP); Tokyu Co., Ltd., Aichi-Ken (JP)

( * ) Notice: Subject to any disclaimer, the term of this patent is extended or adjusted under 35 U.S.C. 154(b) by 295 days.

(21) Appl. No.: 13/625,499

(22) Filed: Sep. 24, 2012

(65) Prior Publication Data

US 2013/0078126 A1 Mar. 28, 2013

(30) Foreign Application Priority Data

Sep. 27, 2011 (JP) ..... 2011-211685

(51) Int. Cl.
*F04B 53/10* (2006.01)
*F04B 27/10* (2006.01)
*F04B 39/10* (2006.01)

(52) U.S. Cl.
CPC ..... *F04B 27/1009* (2013.01); *F04B 39/1066* (2013.01); *F04B 39/1073* (2013.01)

(58) Field of Classification Search
USPC ..... 137/514, 855; 417/565, 569, 570, 571
See application file for complete search history.

(56) References Cited

U.S. PATENT DOCUMENTS 5,226,796 A * 7/1993 Okamoto et al. ..... 417/571
5,884,665 A * 3/1999 Thurston et al. ..... 137/856

(Continued)

FOREIGN PATENT DOCUMENTS

CN 1171492 1/1998
CN 102869885 1/2013

(Continued)

OTHER PUBLICATIONS

Japan Office Action dated Aug. 20, 2013.

(Continued)

*Primary Examiner* — Bryan Lettman
(74) *Attorney, Agent, or Firm* — Greenblum & Bernstein, P.L.C.

(57) ABSTRACT

A compressor includes a discharge chamber, compressor chamber, valve plate, and discharge reed valve. The valve plate includes a fixing surface, exposed to the discharge chamber, and a discharge port, which communicates the discharge chamber and the compression chamber. The discharge reed valve includes a fixed portion, fixed to the fixing surface, a base portion, separable from the valve plate, and a valve portion, which closes the discharge port. The valve plate includes an annular seal surface, recessed groove, receiving surface, and support surface. The seal surface contacts the valve portion around the discharge port. The recessed groove is arranged in the fixing surface outward from the seal surface. The receiving surface is flush with the fixing surface and contacts a distal region of the valve portion. The support surface is flush with the fixing surface and contacts a central region of the valve portion.

8 Claims, 12 Drawing Sheets

(56) References Cited

U.S. PATENT DOCUMENTS

| | | | | |
|---|---|---|---|---|
| 5,890,878 | A | 4/1999 | Murase et al. | |
| 6,336,795 | B1 * | 1/2002 | Yamada | 417/569 |
| 6,402,483 | B1 * | 6/2002 | Kawamura et al. | 417/269 |
| 8,869,837 | B2 | 10/2014 | Moroi et al. | |
| 2004/0076535 | A1 | 4/2004 | Izawa et al. | |
| 2009/0081060 | A1 | 3/2009 | Takai | |
| 2013/0014841 | A1 * | 1/2013 | Moroi et al. | 137/559 |
| 2013/0052066 | A1 | 2/2013 | Moroi et al. | |
| 2013/0129546 | A1 * | 5/2013 | Kurita et al. | 417/559 |

FOREIGN PATENT DOCUMENTS

| | | |
|---|---|---|
| EP | 0959246 | 11/1999 |
| JP | 01-159183 | 11/1989 |
| JP | 08-028449 | 1/1996 |
| JP | 11-117867 | 4/1999 |
| JP | 2001-099065 | 4/2001 |
| JP | 2001-193649 | 7/2001 |
| JP | 2006-226113 | 8/2006 |
| JP | 2007-291881 | 11/2007 |
| JP | 2009-235913 | 10/2009 |
| JP | 2010-169077 | 8/2010 |
| JP | 2011-226464 | 11/2011 |
| JP | 2011-226471 | 11/2011 |
| WO | 99/14494 | 3/1999 |
| WO | 2004/106740 | 12/2004 |

OTHER PUBLICATIONS

China Office action, mail date is Nov. 3, 2014.

* cited by examiner

COMPRESSOR

BACKGROUND OF THE INVENTION

The present invention relates to a compressor.

In a known compressor (e.g., Japanese Laid-Open Patent Publication No. 11-117867), a valve plate is arranged between a discharge chamber and a compression chamber. A discharge port, which extends through the valve plate, can communicate the discharge chamber and the compression chamber. A discharge reed valve, which is located in the discharge chamber, opens and closes the discharge port.

The discharge reed valve is elastically deformable and formed by a plate material of which the front surface and the rear surface are parallel in a normal state. The discharge reed valve includes a fixed portion, which is fixed to the valve plate, a base portion, which extends in a longitudinal direction from the fixed portion and can be lifted from the valve plate, and a valve portion, which extends in the longitudinal direction toward a distal side from the base portion to open and close the discharge port.

The valve plate has a fixing surface that faces the discharge chamber. The fixed portion of the discharge reed valve is fixed to the fixing surface in a state in which the rear surface of the fixing portion is in contact with the fixed portion. The valve plate includes an annular seal surface and an annular recessed groove. The seal surface is flush with the fixing surface, surrounds the discharge port, and can come into contact with the rear surface of the valve portion. The recessed groove is located at the outer side of the seal surface to surround the entire circumference of the discharge port and arranged from the fixing surface.

In this type of compressor, if the deformation (lift) of the discharge reed valve during discharge is small, gas does not smoothly flow out from between the reed valve and the valve plate. This produces a resistance that results in power loss.

To reduce energy consumption, it is desirable that power loss be decreased in the compressor of the prior art described above.

Further, in the compressor described above, the discharge reed valve may be damaged. It is thus desirable that the durability be improved.

SUMMARY OF THE INVENTION

It is an object of the present invention to provide a compressor that can further reduce power loss and improve durability.

In order to achieve the above object, the inventors have analyzed the prior art compressor in detail. As a result, the inventors have focused on decreasing the thickness of the discharge reed valve and the moment the discharge reed valve closes.

More specifically, when the thickness of the discharge reed valve is decreased, the discharge reed valve can be easily bent. Thus, gas can smoothly flow out from between the reed valve and the valve plate without resistance. This reduces the power loss.

However, in the compressor described above, when the thickness of the discharge reed valve is decreased, at the moment the discharge reed valve closes, a distal region of the valve portion is greatly bent into the recessed groove by inertial forces. In this case, a central region of the valve portion is also greatly bent into the discharge port by the inertial force or the pressure difference between the compression chamber and the discharge chamber during a suction stroke. Thus, fatigue failure is apt to occur at the valve portion. This tendency becomes strong particularly when the compressor is operated at high speeds thereby lowering the durability of the compressor.

In this manner, the inventors have completed the present invention.

One aspect of the present invention is a compressor including a discharge chamber and a compression chamber. A valve plate is arranged between the discharge chamber and the compression chamber. The valve plate includes a fixing surface, which is exposed to the discharge chamber, and a discharge port, which communicates the discharge chamber and the compression chamber. An elastically deformable discharge reed valve includes a fixed portion, which is fixed to the fixing surface in contact with the fixing surface, a base portion, which extends in a longitudinal direction of the discharge reed valve from the fixed portion and is separable from the valve plate, and a valve portion, which further extends in the longitudinal direction from the base portion to open and close the discharge port. The valve portion has a distal region including an edge at a distal end in the longitudinal direction. The valve plate includes an annular seal surface that is flush with the fixing surface and can come into contact with the valve portion around the discharge port. A recessed groove is located outward from the seal surface and arranged in the fixing surface. The recessed groove includes a bottom separated from the edge of the valve portion. A receiving surface is flush with the fixing surface and comes into contact with the distal region. A support surface is flush with the fixing surface and comes into contact with a central region of the valve portion located inward from a portion corresponding to the seal surface.

In the compressor of the present invention, even when inertial force acts to move the distal region of the valve portion toward the valve plate at the moment the discharge reed valve closes, the receiving surface, which is flush with the fixing surface of the valve plate, comes into contact with the rear surface of the valve portion at the distal region. Thus, the distal region of the valve portion does not greatly bend into the recessed groove like in the prior art.

Further, in the compressor, when inertial force or a pressure difference acts to move the central region of the valve portion toward the valve plate at the moment the discharge reed valve closes, the support surface, which is flush with the fixing surface of the valve plate, comes into contact with the rear surface of the valve portion at the central region. Thus, the central region of the valve portion does not greatly bend into the discharge port like in the prior art. This suppresses the occurrence of fatigue failure at the valve portion.

Additionally, the compressor allows for reduction in the thickness of the discharge reed. Thus, over-compression can be reduced, and power loss can be suppressed.

Accordingly, the compressor of the present invention further reduces power loss and improves the durability.

In the present invention, the distal region of the valve portion is the region of the valve portion located at the distal side, in the longitudinal direction, of the region where the rear surface comes into contact with the seal surface of the valve plate and includes part of the edge. Further, the central region of the valve portion is the region of the valve portion located inward from the region where the rear surface comes into contact with the seal surface of the valve plate. The central region includes a center region, which will be described later. The rear surface of the valve portion at the central region comes into contact with the support surface.

When the valve plate is viewed from above, the discharge port may be, for example, circular, an oblong opening elongated in a direction orthogonal to the longitudinal direction, triangular, or tetragonal. It is preferred that the valve portion of the discharge reed valve be in conformance with these various shapes. Further, it is preferable that the recessed groove and the seal surface also be in conformance with these various shapes.

Preferably, the valve plate includes an extended portion that extends to divide the discharge port into two, and the support surface is arranged on the extended portion.

In the above structure, the support surface is easily formed in the valve plate. The extended portion does not necessarily have to divide the discharge port into two. The extended portion does not necessarily have to extend toward the center of the discharge port and may be shifted from the center of the discharge port toward any one of the edges of the discharge port.

Preferably, the extended portion extends in a direction orthogonal to the longitudinal direction and divides the discharge port into two in the longitudinal direction.

In the above structure, at the moment the discharge reed valve is lifted at the base portion from the valve plate and the discharge port opens, the extended portion does not interfere with the flow of refrigerant gas. Thus, the refrigerant gas is easily discharged into the discharge chamber from the discharge port located at the distal side in the longitudinal direction. As a result, the discharge resistance is small, and power loss can be reduced.

Preferably, the extended portion includes, in a surface facing the valve portion, a communication groove that comes into communication with the discharge port when the discharge port is closed.

In the above structure, subtle adhesive force act on the rear surface of the valve portion but the pressure of the discharge port acts on the rear surface of the valve portion. Thus, over-compression can be further decreased, and power loss can be further reduced.

Preferably, the support surface includes a central support surface, which includes a center of the discharge port, and an outer support surface, which is continuous with the seal surface. The communication groove is formed between the central support surface and the outer support surface.

The center region of the valve portion is the region located at the central side of the valve portion. The rear surface of the valve portion at the center region comes into contact with the central support surface. In this case, the central support surface and the outer support surface can support the central region of the valve portion, and the communication groove can suppress opening delay of the discharge reed valve and thereby reducing power loss. This is effective when the open area of the discharge port is relatively large or when the thickness of the discharge reed valve is relatively small.

Preferably, the support surface includes an outer support surface that is continuous with the seal surface, and only the outer support surface can come into contact with the central region. The communication groove is formed in the outer support surface.

In the above structure, the center of the valve portion cannot be supported but the central region of the valve portion can be supported with the outer support surface. Further, the communication groove can suppress opening delay of the discharge reed valve and thereby reducing power loss. This is effective when the open area of the discharge port is relatively small or when the thickness of the discharge reed valve is relatively large.

Preferably, the extended portion includes, in a surface facing the valve portion, a recess that does not come into communication with the discharge port when the discharge valve is closed.

In the above structure, subtle adhesive force acts on the rear surface of the valve portion, over-compression can be further decreased, and power loss can be further reduced.

Preferably, the seal surface and the receiving surface are continuous.

Specifically, the recessed groove may be bracket-shaped.

Preferably, the recessed groove is C-shaped and includes two ends, and the seal surface and the receiving surface are continuous in a region between the two ends of the recessed groove.

In the above structure, the rear surface of the valve portion comes into contact with the seal surface and then the receiving surface. Thus, impact applied to the valve portion can be received in a preferred manner. Further, even when the manufacturing error in the arm length varies between discharge reed valves, the advantages of the present invention can be obtained. Moreover, the processing steps of the valve plate can be minimized, and the manufacturing costs can be reduced.

Preferably, the fixing surface includes an elongated groove, and when the discharge valve is viewed from above in a state closing the discharge port, the elongated groove is located at a basal side of the discharge port in the longitudinal direction and extends across the base portion.

In the above structure, a foreign matter is prevented from being caught in the base portion when the discharge reed valve closes the discharge port.

Preferably, the discharge port is formed through a punching process, and the recessed groove, the communication groove, and the elongated groove are formed through a stamping process.

In the above structure, by performing a punching process and stamping process on a workpiece to form the valve plate, the manufacturing costs can be reduced as compared with when performing machining to form the valve plate. It is preferred that the punching of the discharge port and the stamping of the recessed groove, communication groove, and elongated groove be performed on the workpiece from opposite directions.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

First to ninth embodiments of the present invention will now be described with reference to the drawings.

First Embodiment

Figure 1:
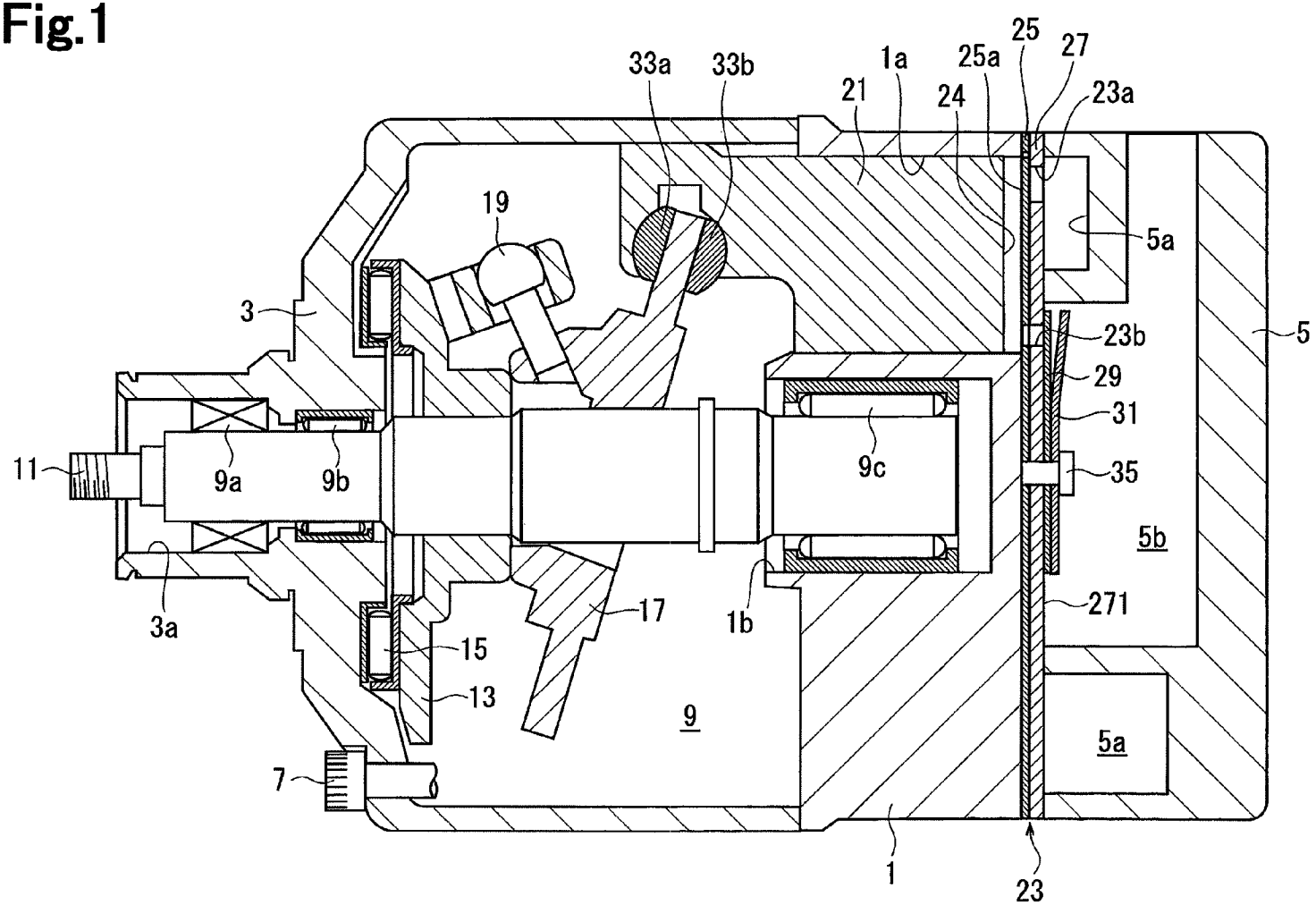
FIG. 1 is a cross-sectional view of a compressor according to first to ninth embodiments of the present invention.

A compressor of a first embodiment is a variable displacement type swash plate compressor. As shown in FIG. 1, the compressor is provided with a cylinder block 1 including a plurality of cylinder bores 1*a*. The cylinder bores 1*a* are concentrically arranged at equal angular intervals and extend parallel to each other. The cylinder block 1 is held between a front housing 3, which is located toward the front, and a rear housing 5, which is located toward the rear, and fastened to the front housing 3 and rear housing 5 by a plurality of bolts 7 in this state. A crank chamber 9 is formed in the cylinder block 1 and the front housing 3. The rear housing 5 includes a suction chamber 5*a* and a discharge chamber 5*b*.

The front housing 3 includes a shaft hole 3*a*, and the cylinder block 1 includes a shaft hole 1*b*. A drive shaft 11 is supported in a rotatable manner by a shaft seal 9*a* and radial bearings 9*b* and 9*c* in the shaft holes 3*a* and 1*b*. A pulley or an electromagnetic clutch (not shown) is arranged on the drive shaft 11. A belt (not shown), which is driven by an engine of a vehicle, runs about the pulley or electromagnetic clutch pulley.

The drive shaft 11 is press-fitted to a lug plate 13, which is arranged in the crank chamber 9. A thrust bearing 15 is arranged between the lug plate 13 and the front housing 3. A swash plate 17 is fitted to the drive shaft 11. A link mechanism 19, which supports the swash plate 17 in a tiltable manner, couples the lug plate 13 and the swash plate 17.

Each cylinder bore 1*a* accommodates a piston 21, which can reciprocate therein. A valve unit 23 is arranged between the cylinder block 1 and the rear housing 5. The valve unit 23 of the compressor includes a suction valve plate 25, which is in contact with a rear end face of the cylinder block 1, a valve plate 27, which is in contact with the suction valve plate 25, a discharge valve plate 29, which is in contact with the valve plate 27, and a retainer plate 31, which is in contact with the discharge valve plate 29. The details of the valve plate 27 and the discharge valve plate 29 will be described later.

Front and rear shoes 33*a* and 33*b*, which form a pair, are arranged between the swash plate 17 and each piston 21. Each pair of the shoes 33*a* and 33*b* convert the wobbling movement of the swash plate 17 into a reciprocating movement of the piston 21.

The crank chamber 9 and the suction chamber 5*a* are connected by a bleed passage (not shown), and the crank chamber 9 and the discharge chamber 5*b* are connected by an air supply passage (not shown). A displacement control valve (not shown) is arranged in the air supply passage. The displacement control valve is formed so that it can vary the open degree of the air supply passage in accordance with the suction pressure. The cylinder bores 1*a*, the pistons 21, and the valve unit 23 form the compression chambers 24. A condenser is connected by a pipe to the discharge chamber 5*b* of the compressor. The condenser is connected by a pipe to an evaporator via an expansion valve, and the evaporator is connected by a pipe to the suction chamber 5*a* of the compressor.

A plurality of suction ports 23*a* are formed in the valve plate 27 to communicate the suction chamber 5*a* and the compression chambers 24. The suction valve plate 25 includes a plurality of suction reed valves 25*a* that open and close the suction ports 23*a*.

Figure 2:
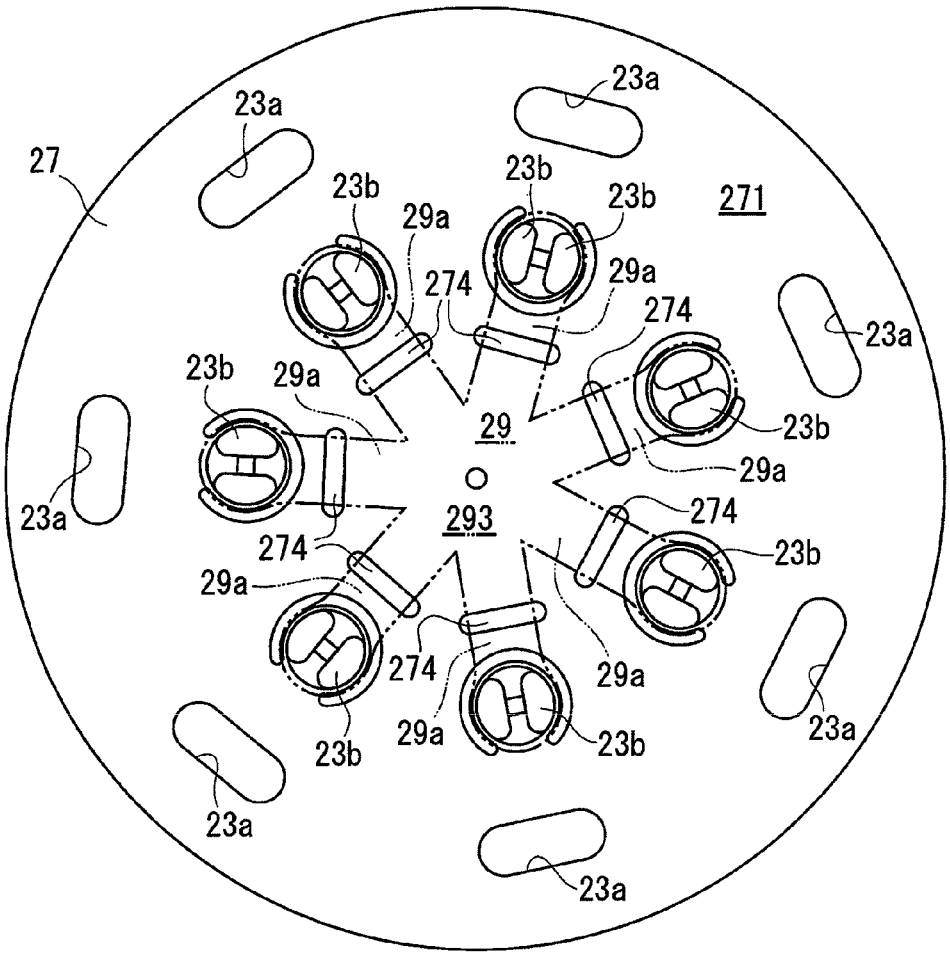
FIG. 2 is a plan view showing a valve plate of a compressor according to the first embodiment of the present invention.

A plurality of discharge ports 23*b* are formed in the suction valve plate 25 and the valve plate 27 to communicate the compression chambers 24 and the discharge chamber 5*b*. In the first embodiment, the discharge valve plate 29 is pressed out of a sheet of spring steel having a thickness of 0.305 mm. As shown in FIG. 2, the discharge valve plate 29 includes a plurality of discharge reed valves 29*a*, which extend radially, to open and close the discharge ports 23*b*. As shown in FIGS. 3B and 3C, each discharge reed valve 29*a* is elastically deformable and is formed by a plate having a front surface 291 and a rear surface 292, which are parallel in a normal state.

As shown in FIGS. 1 and 2, each discharge reed valve 29*a* includes a fixed portion 293, a base portion 294, and a valve portion 295. The fixed portion is located at the center of the discharge valve plate 29 and fixed by a bolt 35 to the valve plate 27. The base portion 294 extends in a longitudinal direction D, which is the radial direction, from the fixed portion 293 and can be lifted from the valve plate 27. The valve portion 295 extends in the longitudinal direction D toward a distal side from the base portion 294 to open and close the discharge port 23*b*. In the first embodiment, the base portion 294 is rectangular and has long sides extending in the longitudinal direction D. The valve portion 295 is circular and has a diameter that is greater than or equal to the length of the short sides of the base portion 294. In this manner, the discharge reed valve 29*a* is shaped to greatly open the corresponding discharge port 23*b*.

Figure 3A:
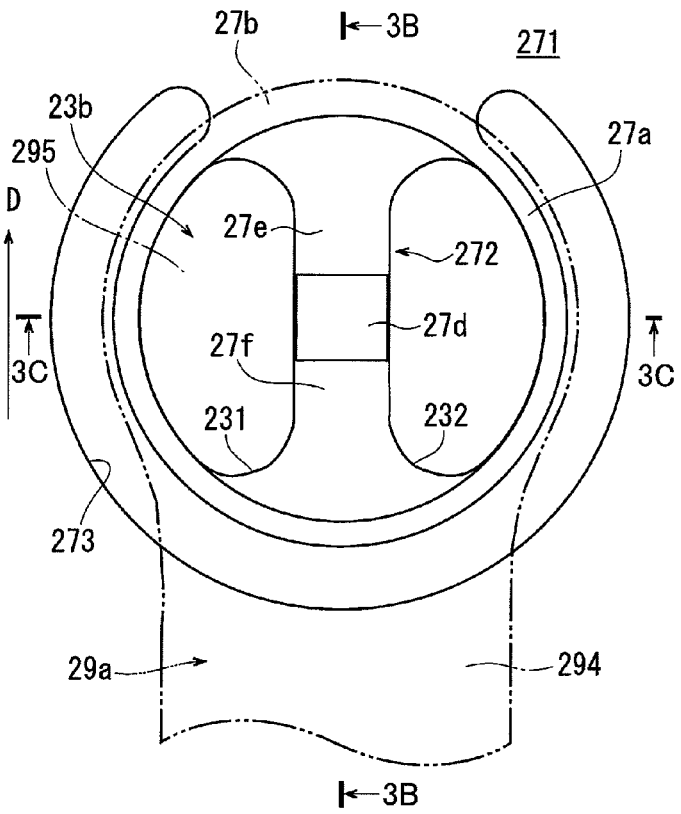
FIG. 3A is a plan view showing a discharge port of FIG. 2.
Figure 3B:
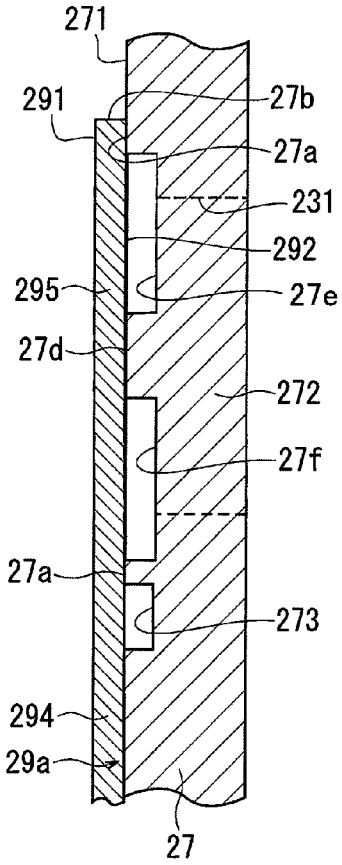
FIG. 3B is a cross-sectional view taken along line 3B-3B in FIG. 3A.
Figure 3C:
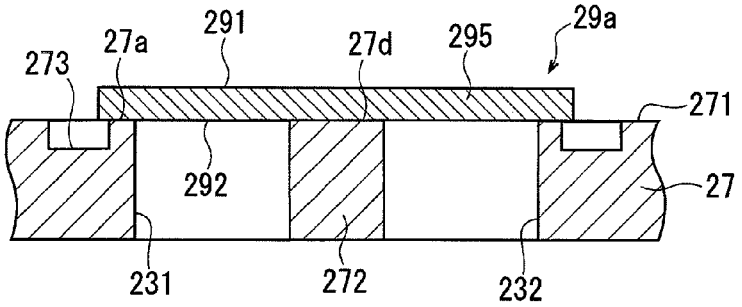
FIG. 3C is a cross-sectional view taken along line 3C-3C in FIG. 3A.
Figure 4:
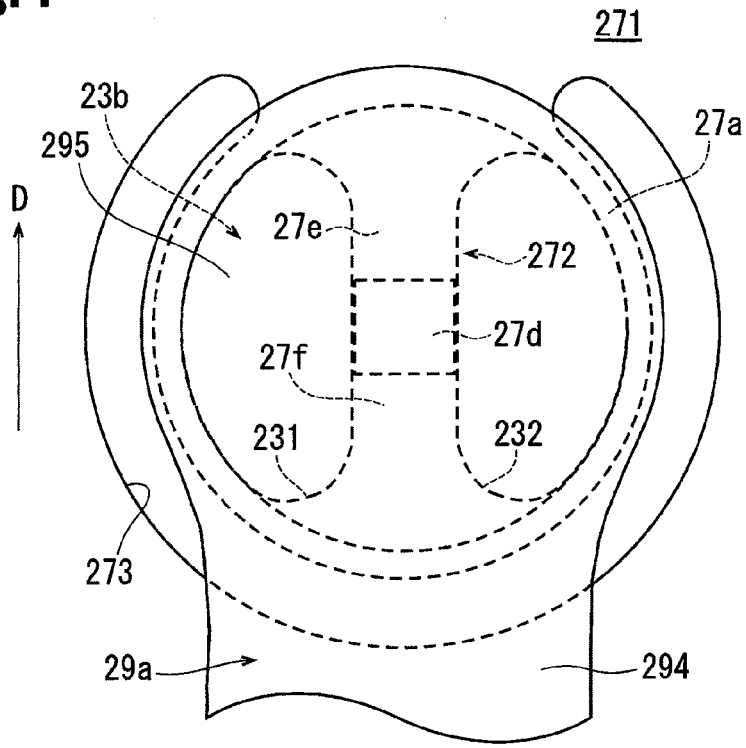
FIG. 4 is an enlarged plan view showing the valve plate and the discharge reed valve of FIG. 2.

As shown in FIGS. 3A to 4, the valve plate 27 includes a fixing surface 271 facing the discharge chamber 5*b*. The fixed portion 293 contacts the rear surface 292 with the fixing surface 271, the rear surface 292 is fixed to the fixing surface 271. The valve plate 27 includes an extended portion 272 that extends in the longitudinal direction D. The extended portion 272 divides the discharge port 23*b* into two so that a left half and a right half are arranged next to each other in a direction orthogonal to the longitudinal direction D. More specifically, the extended portion 272 divides the discharge port 23*b* into two half-moon-shaped port segments 231 and 232. The port segments 231 and 232 are arranged so that the discharge port 23*b* is circular in its entirety when viewed from above.

Figure 5:
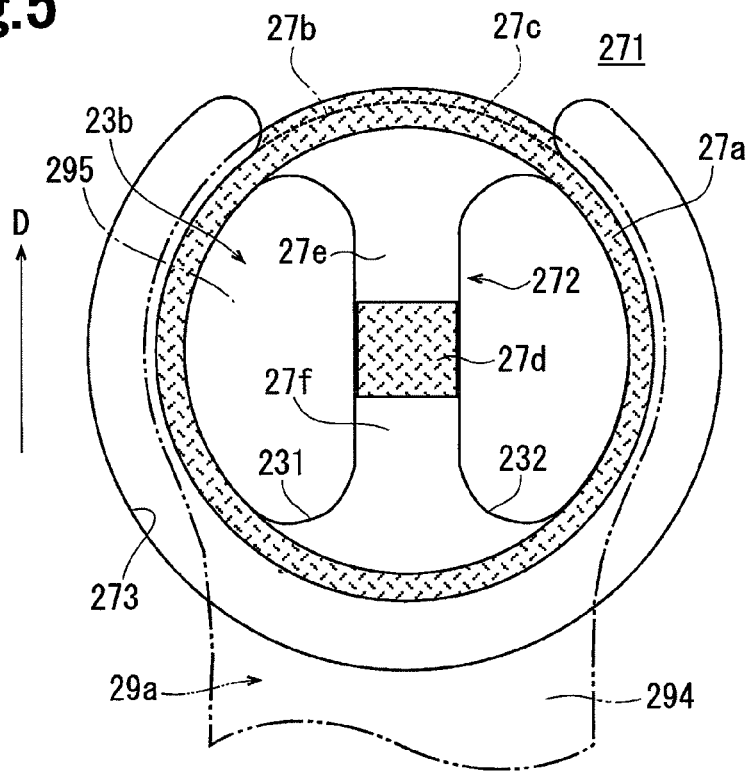
FIG. 5 is an enlarged plan view showing the valve plate of FIG. 2.

A recessed groove 273, which is C-shaped as viewed from above to be non-continuous at the distal side in the longitudinal direction D, is arranged in the fixing surface 271 in the valve plate 27. As shown in FIG. 5, the valve plate 27 includes a seal surface 27*a* between the discharge port 23*b* and the recessed groove 273. The seal surface 27*a* is flush with the fixing surface 271. The seal surface 27*a* is annular and can come into contact with the rear surface 292 of the valve portion 295 around the discharge port 23*b*. The recessed groove 273 is arranged in the fixing surface 271 at the outer side of the seal surface 27*a* and includes a bottom portion separated from the two edges of the valve portion 295 and the base portion 294. That is, a gap is formed between the bottom portion and the two edges of the valve portion 295 and between the bottom portion and the base portion 294.

A receiving surface 27*b* is formed in the valve plate 27 at the distal side in the longitudinal direction D where the recessed groove 273 is non-continuous, that is, an area between the two ends of the C-shaped recessed groove 273. The receiving surface 27*b* is also flush with the fixing surface 271. The receiving surface 27*b* can come into contact with the rear surface 292 at a distal region of the valve portion 295. Referring to FIG. 5, the seal surface 27*a* and the receiving surface 27*b* come into contact with the rear surface 292 of the valve portion 295 as indicated by a pattern area. The boundary of the seal surface 27*a* and the receiving surface 27*b* is indicated by an arc 27*c* shown in the pattern area. However, the seal surface 27*a* and the receiving surface 27*b* are continuous.

A support surface 27*d* is formed in the middle of the extended portion 272 at the surface facing the valve portion 295. The support surface 27*d* is also flush with the fixing surface 271. The support surface 27*d* can come into contact with the rear surface 292 at a central region of the valve portion 295. Communication grooves 27*e* and 27*f* are formed in the extended portion 272 extending from the front toward the rear of the support surface 27*d*. The communication grooves 27*e* and 27*f* are recessed from the fixing surface 271 so that the port segments 231 and 232 are in communication when the valve portion 295 closes. In FIG. 5, the support surface 27*d*, which comes into contact with the rear surface 292 of the valve portion 295, is also indicated by a pattern area.

As shown in FIG. 2, the fixing surface 271 is formed with a plurality of elongated grooves 274. Each groove 274 extends across the base portion 294 in a lateral direction at a basal side of the corresponding discharge port 23*b* in the longitudinal direction D. The recessed groove 273 and the elongated groove 274 may be in communication with each other at the rear side of the base portion 294 in each discharge reed valve 29*a*.

Figure 6:
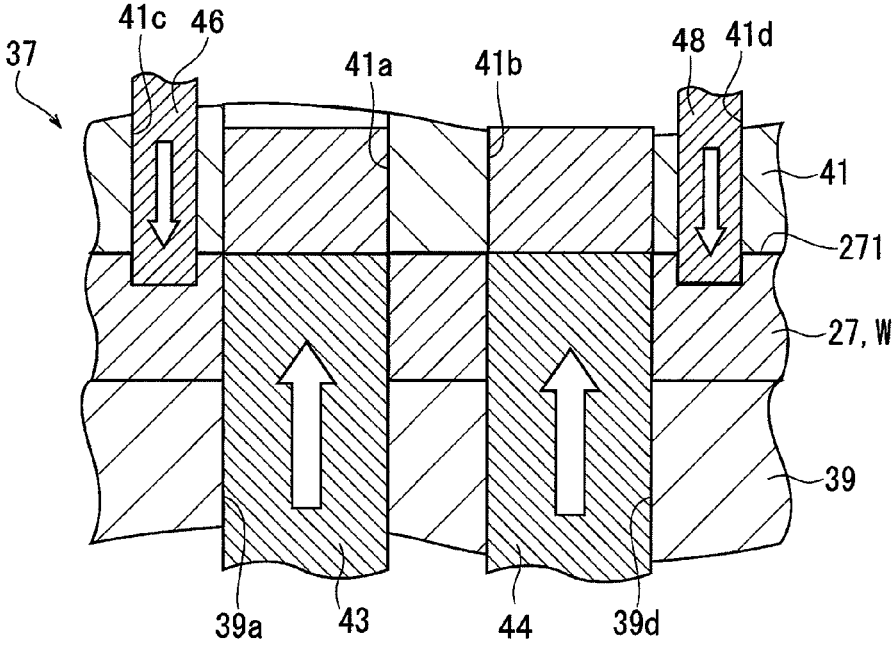
FIG. 6 is a schematic cross-sectional view showing manufacturing steps of the valve plate of FIG. 2.

The valve plate 27 is formed by dies 37 shown in FIG. 6. The dies 37 include a lower die 39 and an upper die 41. A workpiece W that forms the valve plate 27 is held between the lower die 39 and the upper die 41. Punching holes 39*a*, 39*d* are formed in the lower die 39 extending in the vertical direction. The punching holes 39*a* and 39*d* are arranged at positions corresponding to the port segments 231 and 232. Punches 43 and 44 are respectively arranged in the punching holes 39*a* and 39*d* to be movable in the vertical direction.

Disposal holes 41*a* and 41*b* are formed in the upper die 41 extending in the vertical direction in alignment with the punching holes 39*a* and 39*d*. Punching holes 41*c* and 41*d* and the like are also formed in the upper die 41 extending in the vertical direction at positions corresponding to the recessed groove 273, the communication grooves 27*e* and 27*f*, and the elongated groove 274 in the upper die 41. Punches 46, 48, and the like are respectively arranged in the punching holes 41*c*, 41*d*, and the like to be movable in the vertical direction.

When forming the valve plate 27 from the workpiece W, the workpiece W is first held between the lower die 39 and the upper die 41. Then, the punches 43 and 44 are raised from the lower side, and the punches 46, 48, and the like are lowered from the upper side. This punches out the port segments 231 and 232 from the workpiece W and stamps the recessed groove 273, the communication grooves 27*e* and 27*f*, and the elongated groove 274 in the workpiece W. After the processing, the surface of the workpiece W undergoes polishing to complete the valve plate 27. This lowers the manufacturing cost as compared to when performing machining to form the valve plate 27.

In the compressor, when the drive shaft 11 shown in FIG. 1 is rotated, the lug plate 13 and the swash plate 17 are rotated synchronously with the drive shaft 11, and the pistons 21 are reciprocated in the cylinder bores 1*a* with a stroke corresponding to the tilting angle of the swash plate 17. This draws refrigerant gas drawn from the suction chamber 5*a* into each compression chamber 24 and compresses the refrigerant gas. Then, the refrigerant gas is discharged to the discharge chamber 5*b*. The refrigerant gas compressed by the compressor contains atomized lubricating oil. The lubricating oil collects on sliding and moving parts such as the pistons 21, the shoes 33*a* and 33*b*, the swash plate 17, and the like to suppress wear.

During operation of the compressor, the difference in pressure between the discharge chamber 5*b* and the compression chamber 24 elastically deforms the discharge reed valve 29*a* at the base portion 294. As a result, the valve portion 295 opens the discharge port 23*b*. In the compressor, at the moment the discharge reed valve 29*a* closes, inertial force acts to move the distal region of the valve portion 295 toward the valve plate 27. However, the valve plate 27 includes the receiving surface 27*b*, which is flush with the fixing surface 271. Thus, the receiving surface 27*b* comes into contact with the rear surface 292 at the distal region of the valve portion 295. Thus, the distal region of the valve portion 295 thus does not greatly bend into the recessed groove 273.

In particular, the seal surface 27*a* and the receiving surface 27*b* are continuous, and the rear surface 292 of the valve portion 295 comes into contact with the receiving surface 27*b* and then the seal surface 27*a*. Thus, even when the manufacturing error in the arm length varies between the discharge reed valves 29*a*, the valve portion 295 can receives impacts in a preferable manner. Further, the number of processing steps of the valve plate 27 can be minimized, and the manufacturing cost can be lowered.

Further, in the compressor, the valve plate 27 includes the support surface 27*d* that is flush with the fixing surface 271. Thus, at the moment the discharge reed valve 29*a* closes, inertial force or pressure difference acts to move the central region of the valve portion 295 toward the valve plate 27. However, the support surface 27*d* comes into contact with the rear surface 292 at the central region of the valve portion 295. Thus, the central region of the valve portion 295 thus does not greatly bend into the discharge port 23*b*. For the reasons discussed above, fatigue failure is unlikely to occur at the valve portion 295.

Further, in the compressor, the communication grooves 27*e* and 27*f* are arranged in the surface of the extended portion 272 facing the valve portion 295. Thus, at the moment the discharge reed valve 29*a* opens, adhesive force is unlikely to act on the rear surface 292 of the valve portion 295. In contrast, the pressure of the discharge port 23*b* acts on the rear surface 292. As a result, over-compression can be further decreased, and power loss can be further reduced.

Further, in the compressor, the elongated grooves 274 are formed in the fixing surface 271. The elongated grooves 274 prevents foreign matter from being caught in the base portion 294 when each discharge reed valve 29*a* closes the corresponding discharge port 23*b*.

As described below, the compressor decreases the thickness of the discharge reed valve 29*a* while also reducing over-compression and suppressing power loss.

Accordingly, the compressor can further reduce power loss and improve the durability.

Further, the compressor suppresses opening delays of the discharge reed valve 29*a* and decreases discharging pulsations. This improves the quietness of the compressor. Further, in the compressor, the reduction of over-compression lowers the impact force, bearing load, piston side force (lateral force), and the like. Thus, mechanical loss can be reduced and wear can be suppressed. As a result, power consumption can be decreased and reliability can be improved.

Second Embodiment

Figure 7:
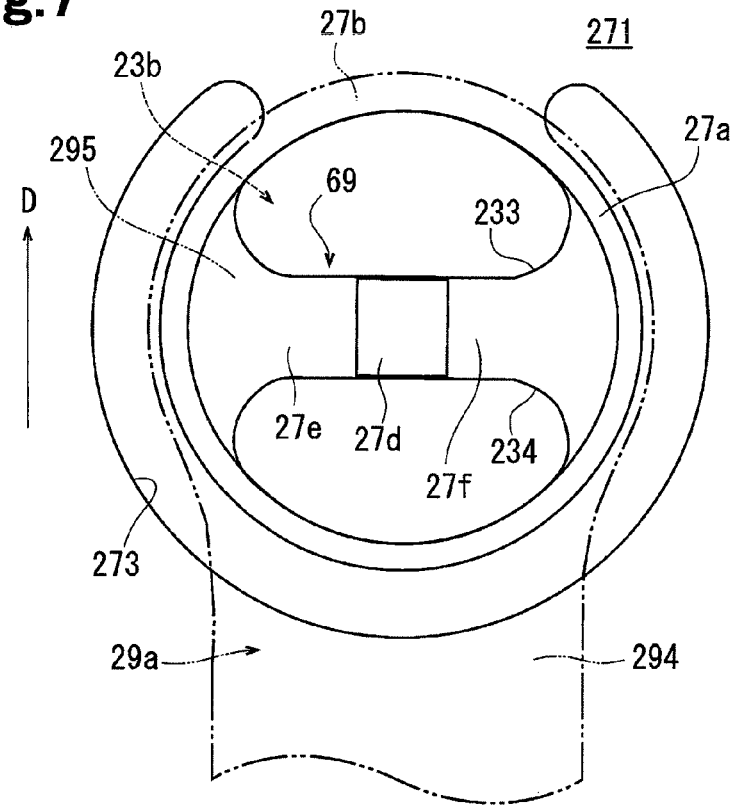
FIG. 7 is an enlarged plan view showing a valve plate of a compressor according to the second embodiment of the present invention.

The compressor of the second embodiment uses an extended portion 69 shown in FIG. 7. The extended portion 69 extends in a direction orthogonal to the longitudinal direction D in the valve plate 27 and divides the discharge port 23*b* into two so that a forward half and a rearward half are arranged next to each other in the longitudinal direction D. More specifically, the extended portion 69 divides the discharge port 23*b* into two half-moon shaped port segments 233 and 234. Otherwise, the structure is the same as the first embodiment.

When the discharge reed valve 29*a* is lifted from the valve plate 27, the valve portion 295 opens the discharge port 23*b* from the distal side in the longitudinal direction D. Here, the extended portion 69 does not interfere with the flow of refrigerant gas. Thus, the refrigerant gas is easily discharged to the discharge chamber 5*b* from the port segment 233 located at the distal side in the longitudinal direction D. As a result, the discharge resistance is small, and the power loss can be prevented from being increased. This structure also obtains the other advantages of the first embodiment.

Third Embodiment

Figure 8:
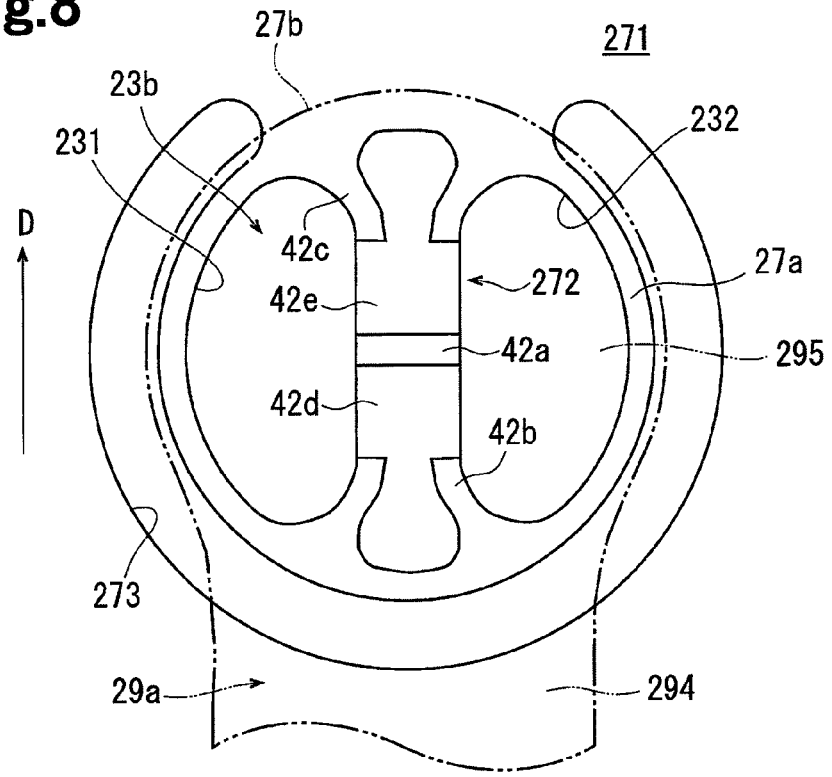
FIG. 8 is an enlarged plan view showing a valve plate and a discharge reed valve of a compressor according to the third embodiment of the present invention.

As shown in FIG. 8, in the compressor of the third embodiment, a central support surface 42*a* is formed at the center of the extended portion 272. The central support surface 42*a* extends in a lateral direction of the extended portion 272, that is, in a direction orthogonal to the longitudinal direction D. The central support surface 42*a* can come into contact with the rear surface 292 at the central region of the valve portion 295.

Outer support surfaces 42*b* and 42*c* are formed at the basal and distal sides of the extended portion 272 in the longitudinal direction D. The outer support surfaces 42*b* and 42*c* are each substantially U-shaped and open toward the central side of the discharge port 23*b*. The outer support surfaces 42*b* and 42*c* are located outward from the central support surface 42*a* and are continuous with the seal surface 27*a*.

Communication grooves 42*d* and 42*e* are formed between the central support surface 42*a* and the outer support surfaces 42*b* and 42*c*. The communication groove 42*d* also extends into the outer support surface 42*b*, and the communication groove 42*e* also extends into the outer support surface 42*c*.

Figure 9:
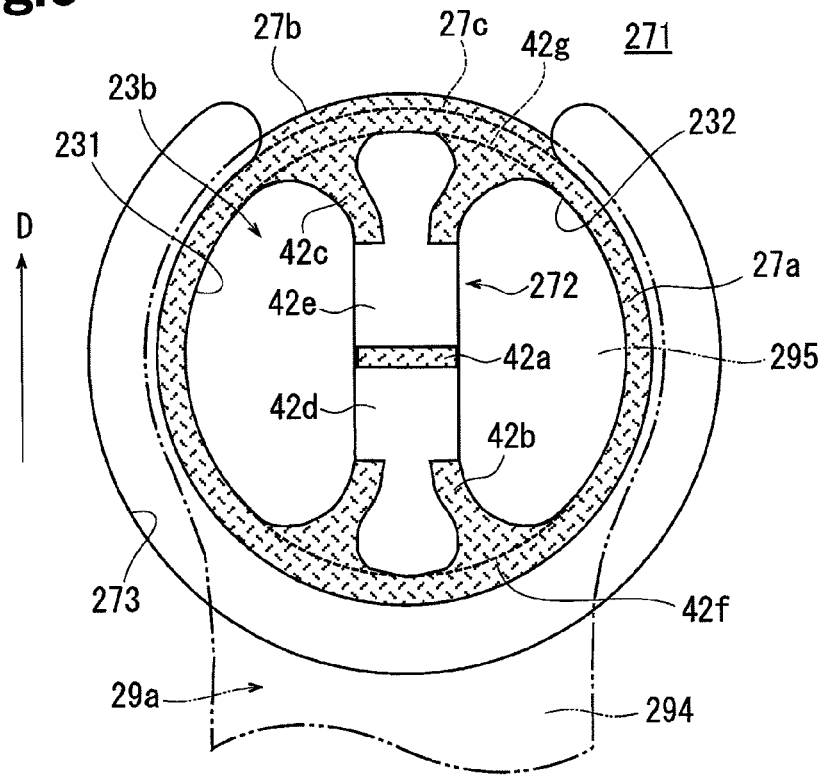
FIG. 9 is an enlarged plan view showing the valve plate of FIG. 8.

In FIG. 9, in the same manner as the seal surface 27*a* and the receiving surface 27*b*, the central support surface 42*a* and the outer support surfaces 42*b* and 42*c* that come into contact with the rear surface 292 of the valve portion 295 are indicated by a pattern area. The boundaries of the seal surface 27*a* and the outer support surfaces 42*b* and 42*c* are indicated by arcs 42*f* and 42*g* shown in the pattern area. However, the seal surface 27*a* and the outer support surfaces 42*b* and 42*c* are continuous. Otherwise, the structure is the same as the first embodiment.

In this compressor, the central region of the valve portion 295 can be supported by the central support surface 42*a* and the outer support surfaces 42*b* and 42*c*. Further, the communication grooves 42*d* and 42*e* suppress opening delay of the discharge reed valve 29*a* and thereby reducing power loss. This structure also obtains the other advantages of the first embodiment.

Fourth Embodiment

Figure 10:
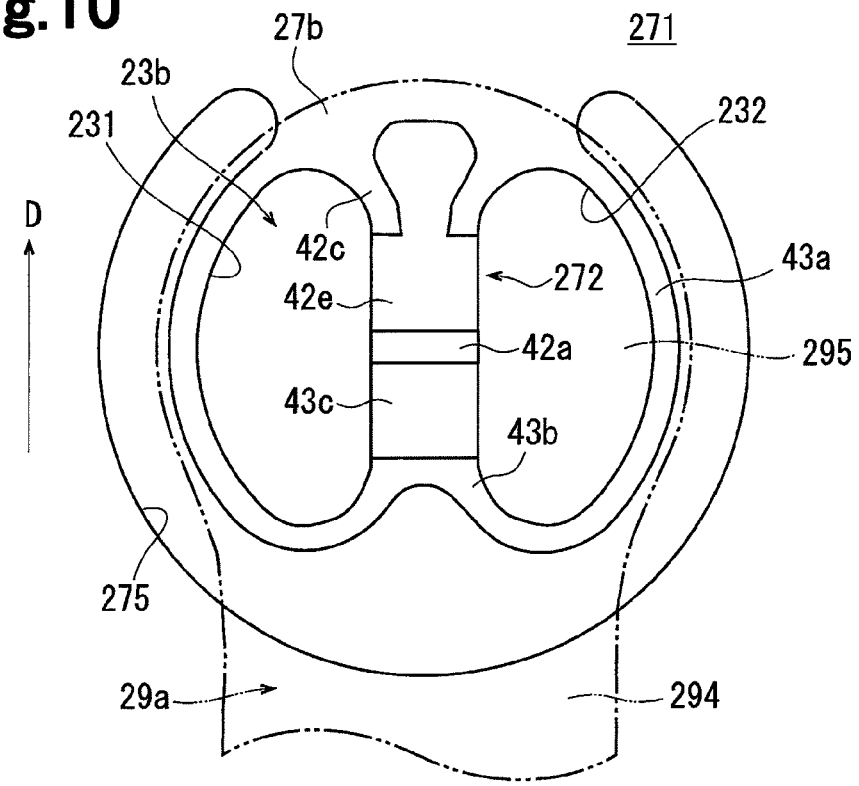
FIG. 10 is an enlarged plan view showing a valve plate and a discharge reed valve of a compressor according to the fourth embodiment of the present invention.
Figure 11:
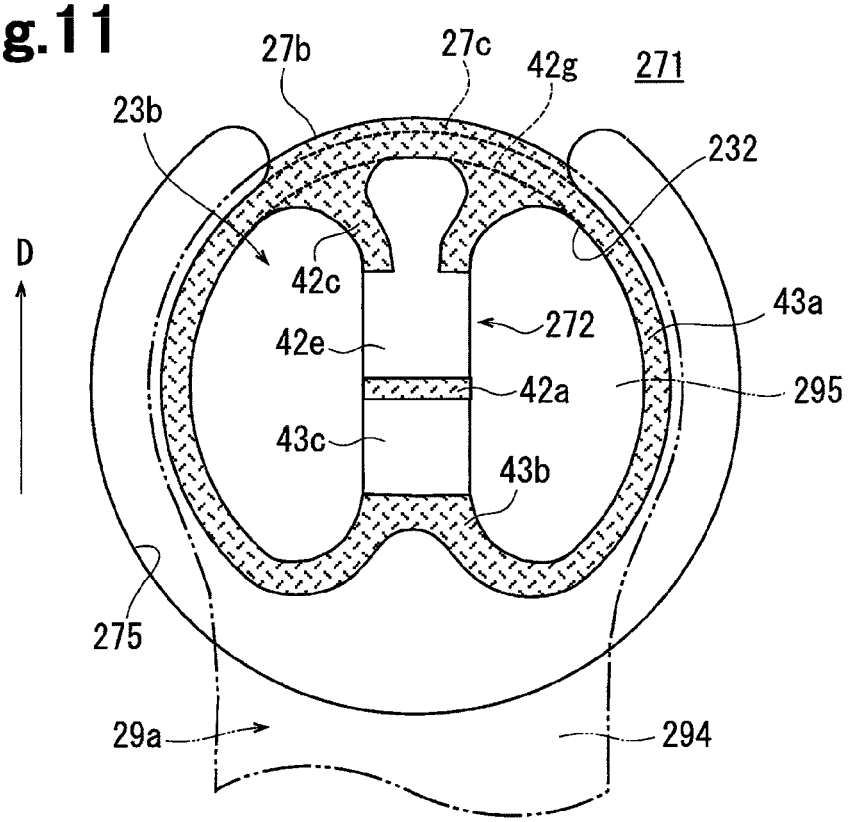
FIG. 11 is an enlarged plan view showing the valve plate of FIG. 10.

The compressor of the fourth embodiment includes the recessed groove 275, a seal surface 43*a*, an outer support surface 43*b*, and a communication groove 43*c* as shown in FIGS. 10 and 11. The recessed groove 275 differs from the recessed groove 273 shown in FIG. 3 in that its basal side in the longitudinal direction D extends toward the distal side. Thus, the seal surface 43*a* differs from the seal surface 27*a* shown in FIG. 3 in that the basal side in the longitudinal direction D extends toward the distal side integrally with the outer support surface 43*b*. The communication groove 43*c* does not extend into the outer support surface 43*b*. Otherwise, the structure is the same as the third embodiment.

This compressor has the same advantages as the third embodiment.

Fifth Embodiment

Figure 12:
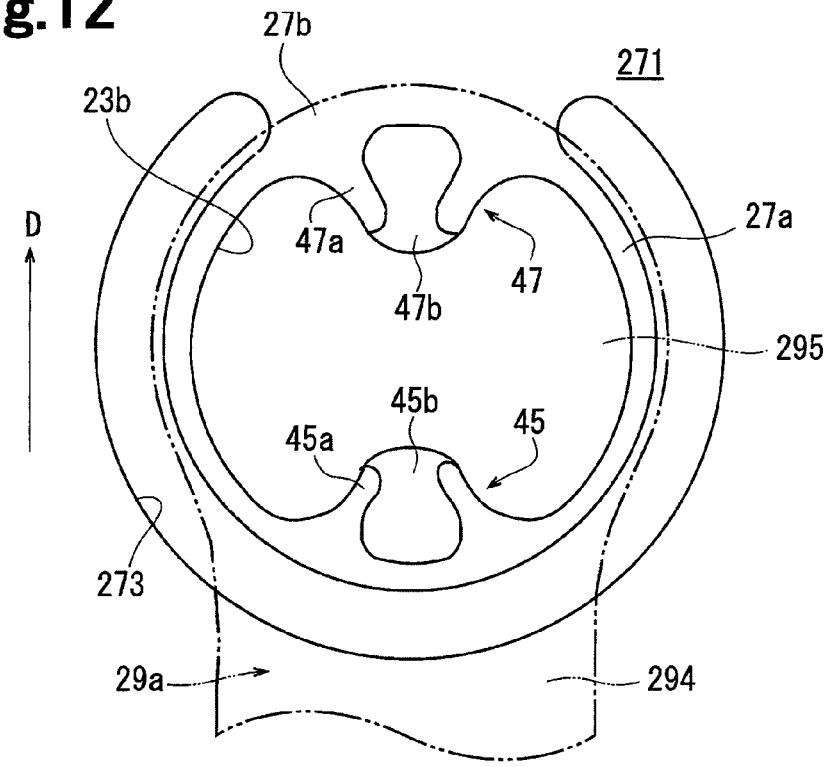
FIG. 12 is an enlarged plan view showing a valve plate and a discharge reed valve of a compressor according to the fifth embodiment of the present invention.

As shown in FIG. 12, in the compressor of the fifth embodiment, the valve plate 27 includes extended portions 45 and 47. The extended portion 45 is extended over a short distance from the basal side in the longitudinal direction D toward the center of the discharge port 23*b*. The extended portion 47 is extended over a short distance from the distal side of the longitudinal direction D toward the center of the discharge port 23*b*. The discharge port 23*b* is not divided into two by the extended portions 45 and 47 and is hourglass-shaped.

An outer support surface 45*a* is formed in the extended portion 45, and an outer support surface 47*a* is formed in the extended portion 47. The outer support surfaces 45*a* and 47*a* are each substantially U-shaped and open toward the center of the discharge port 23*b*. The outer support surfaces 45*a* and 47*a* are continuous with the seal surface 27*a*.

Figure 13:
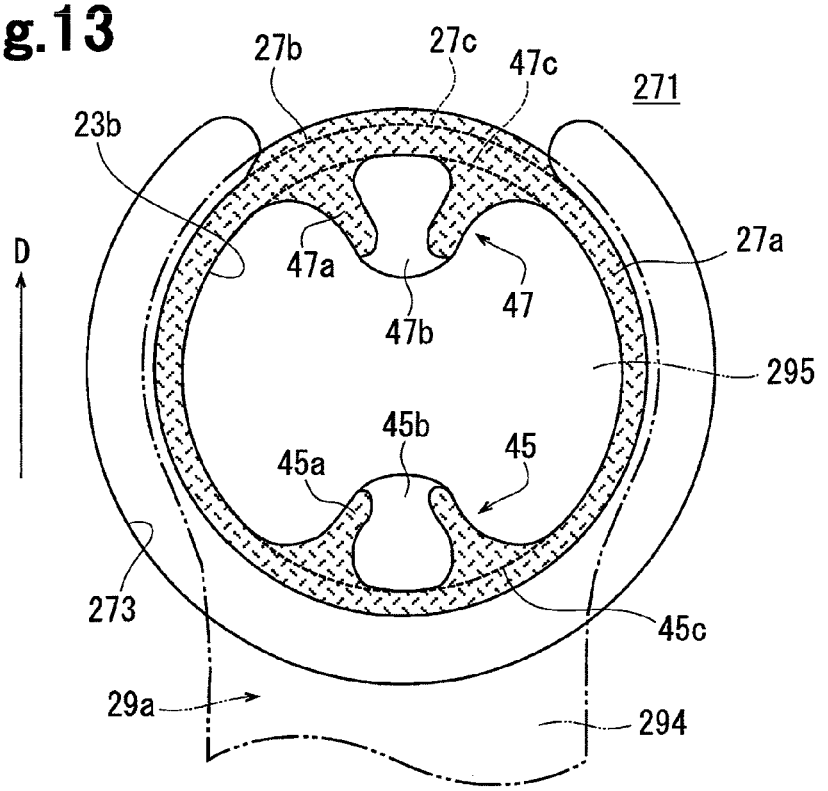
FIG. 13 is an enlarged plan view showing the valve plate of FIG. 12.

Communication grooves 45*b* and 47*b* are formed in the outer support surfaces 45*a* and 47*a*, respectively. In FIG. 13, the boundaries of the seal surface 27*a* and the outer support surfaces 45*a* and 47*a* are indicated by arcs 45*c* and 47*c* shown in the pattern area. Otherwise, the structure is the same as the first embodiment.

In the compressor, the center of the valve portion 295 cannot be supported. However, the central region of the valve portion 295 can be supported by the outer support surfaces 45*a* and 47*a*. Further, the communication grooves 45*b* and 47*b* suppress opening delay of the discharge reed valve 29*a* and thereby reducing the power loss. This compressor has the same advantages as the first embodiment.

Sixth Embodiment

Figure 14:
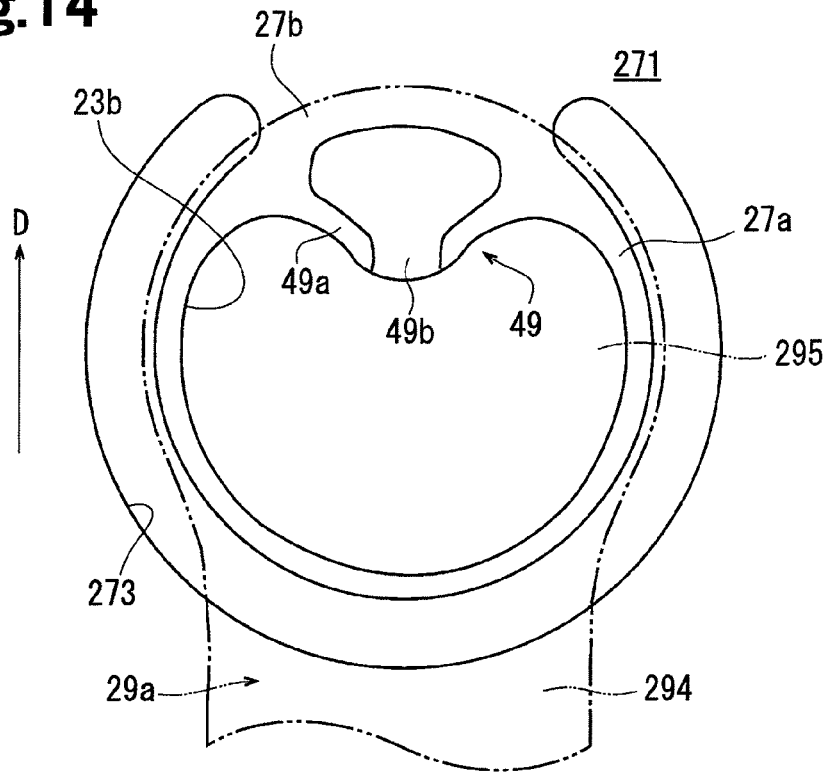
FIG. 14 is an enlarged plan view showing a valve plate and a discharge reed valve of a compressor according to the sixth embodiment of the present invention.

The compressor of the sixth embodiment includes an extended portion 49 shown in FIG. 14. The extended portion 49 extends over a short distance from the distal side of the discharge port 23*b* in the longitudinal direction D toward the center. The extended portion 49 is slightly longer and has slightly wider than the extended portion 47 of the fifth embodiment. The discharge port 23*b* is not divided into two by the extended portion 49 and has a curved shape.

Figure 15:
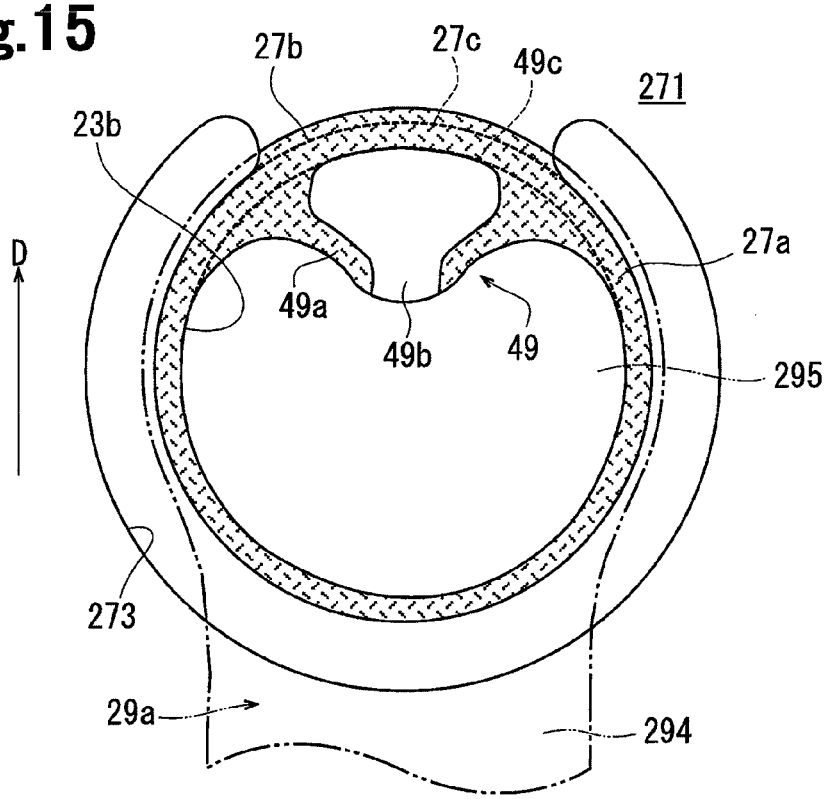
FIG. 15 is an enlarged plan view showing the valve plate of FIG. 14.

The extended portion 49 includes an outer support surface 49*a*. The outer support surface 49*a*, which is substantially U-shaped and open toward the center of the discharge port 23*b*, is continuous with the seal surface 27*a*. In FIG. 15, the boundary of the seal surface 27*a* and the outer support surface 49*a* is shown by an arc 49*c* in the pattern area. A communication groove 49*b* is formed in the outer support surface 49*a*. Otherwise, the structure is the same as the fifth embodiment.

This compressor has the same advantages as the third embodiment.

Seventh Embodiment

Figure 16:
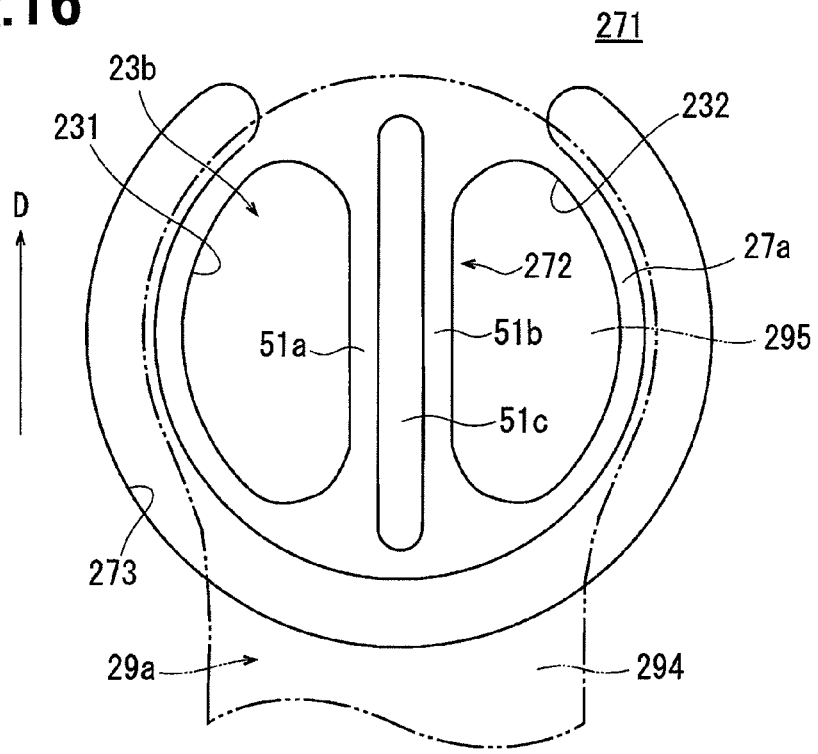
FIG. 16 is an enlarged plan view showing a valve plate and a discharge reed valve of a compressor according to the seventh embodiment of the present invention.
Figure 17:
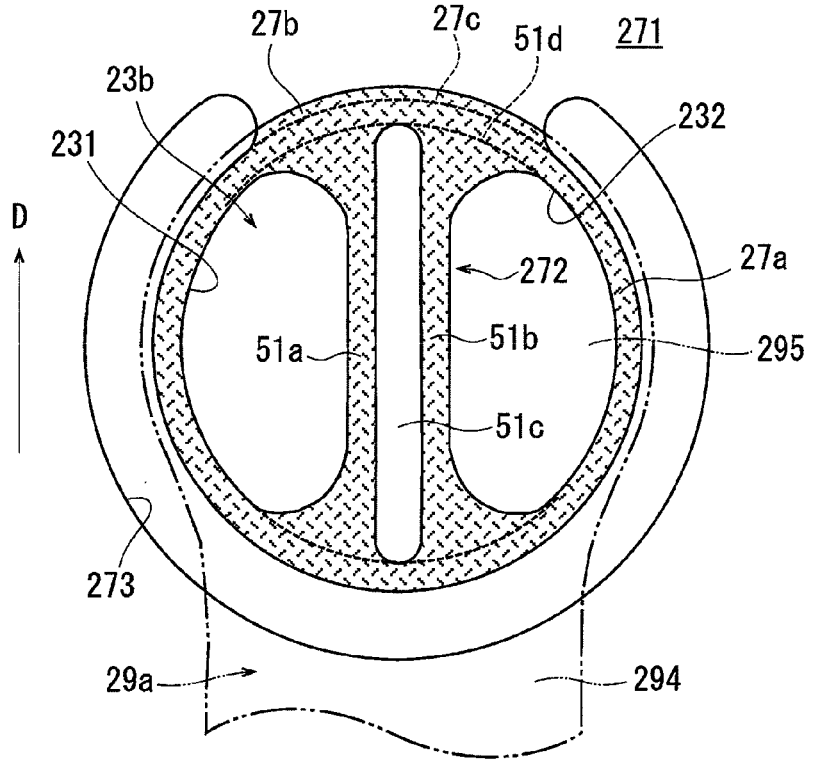
FIG. 17 is an enlarged plan view showing the valve plate of FIG. 16.

As shown in FIG. 16, the compressor of the seventh embodiment includes an extended portion 272 that extends in the longitudinal direction D to divide the discharge port 23*b* into two. Support surfaces 51*a* and 51*b* are formed at the two lateral sides of the extended portion 272 on the surface facing the valve portion 295. The support surfaces 51*a* and 51*b* are flush with the fixing surface 271. Referring to FIG. 17, the boundary of the seal surface 27*a* and the support surfaces 51*a* and 51*b* are indicated by a circle 51*d* shown in the pattern area. However, the seal surface 27*a* and the support surfaces 51*a* and 51*b* are continuous.

A recess 51*c* is formed between the support surfaces 51*a*, 51*b*. The recess 51*c*, which is arranged in the fixing surface 271, is not in communication with the port segments 231 and 232 due to the support surfaces 51*a* and 51*b*. Otherwise, the structure is the same as the third embodiment.

In this compressor, the recess 51*c* does not communicate with the port segments 231 and 232 when the valve closes. Thus, the pressure of the discharge port 23*b* does not act on the rear surface 292 of the valve portion 295. However, the recess 51*c* prevents adhesive force from acting on the rear surface of the valve portion 295. Thus, this compressor can further decrease over-compression due to the opening delay of the discharge reed valve 29*a* and further reduce power loss. The other advantages are the same as the third embodiment.

Eighth Embodiment

Figure 18:
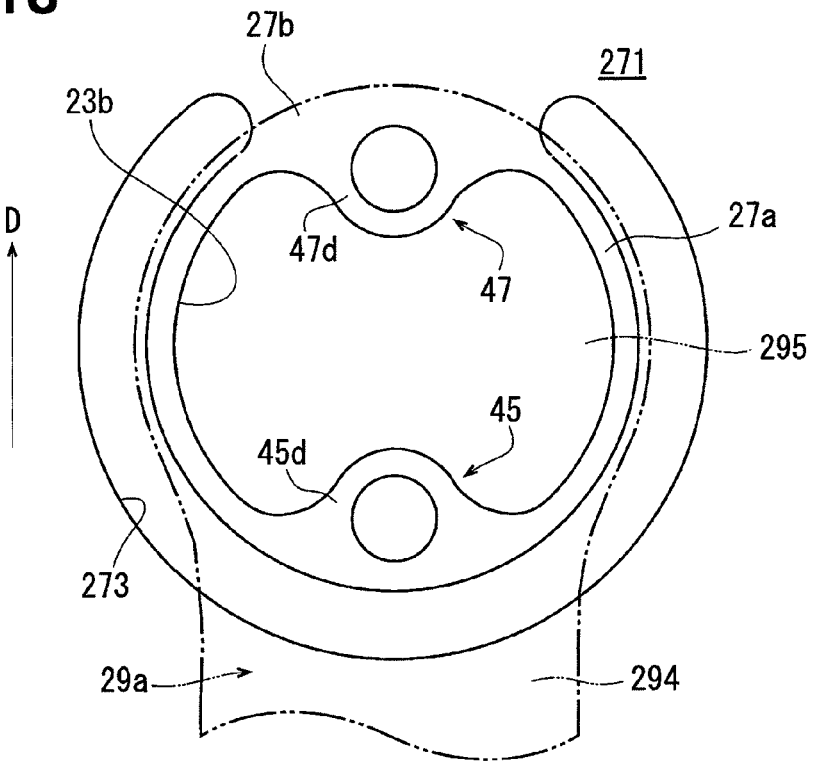
FIG. 18 is an enlarged plan view showing a valve plate and a discharge reed valve of a compressor according to the eighth embodiment of the present invention.
Figure 19:
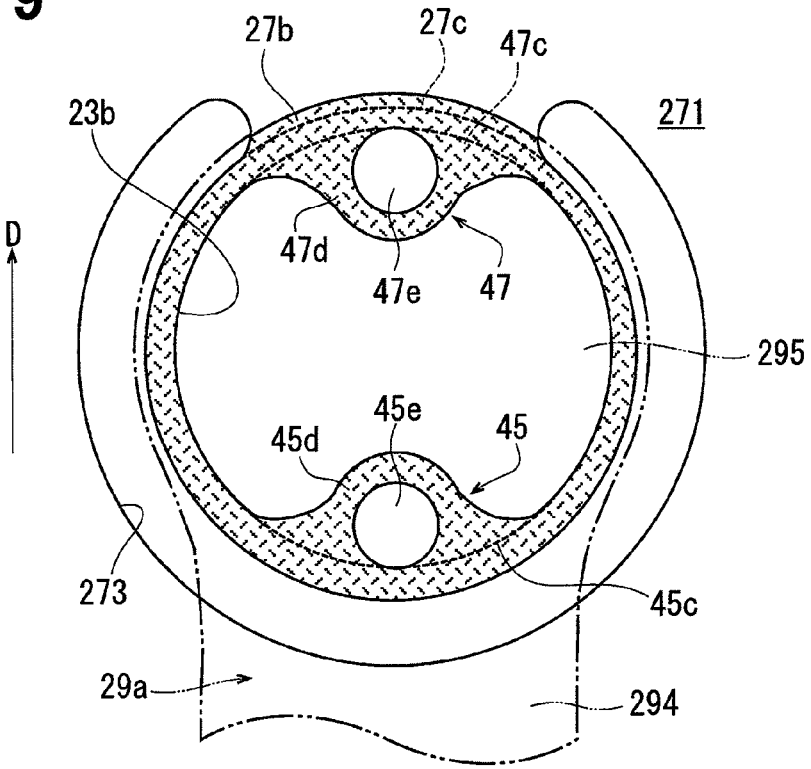
FIG. 19 is an enlarged plan view showing the valve plate of FIG. 18.

As shown in FIGS. 18 and 19, the compressor of the eighth embodiment includes extended portions 45 and 47 that do not divide the discharge port 23*b* into two. Support surfaces 45*d* and 47*d* are formed on the extended portions 45 and 47 on the surface facing the valve portion 295. The support surfaces 45*d* and 47*d* are flush with the fixing surface 271. The seal surface 27*a* and the support surfaces 45*d* and 47*d* are continuous.

Recesses 45*e* and 47*e* are formed in the support surfaces 45*d* and 47*d*, respectively. The recesses 45*e* and 47*e*, which are arranged in the fixing surface 271, are not in communication with the discharge port 23*b* due to the support surfaces 45*d*, 47*d*. Otherwise, the structure is the same as the fifth embodiment.

This compressor has the same advantages as the third and the seventh embodiments.

Ninth Embodiment

Figure 20:
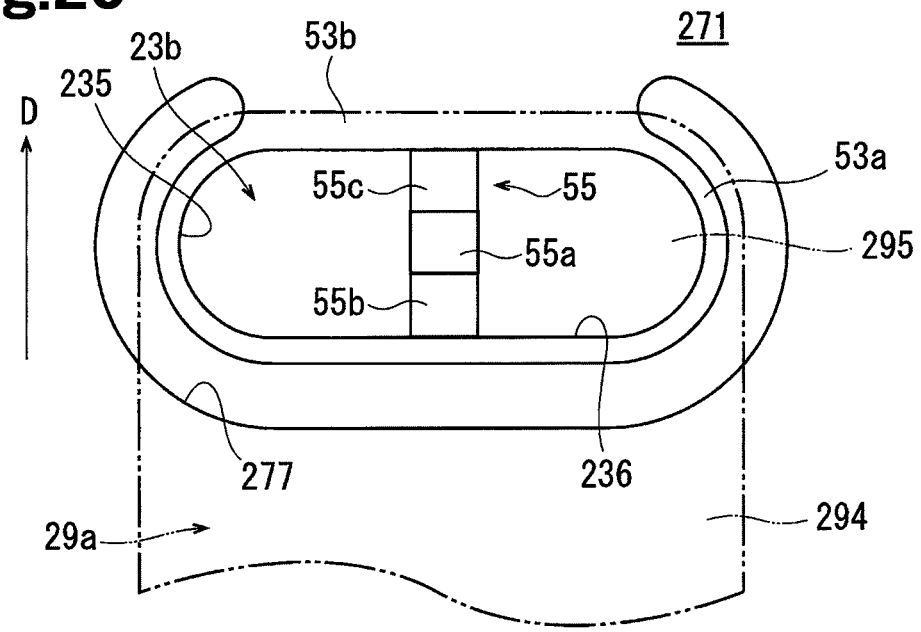
FIG. 20 is an enlarged plan view showing a valve plate and a discharge reed valve of a compressor according to the ninth embodiment of the present invention.

With reference to FIG. 20, the compressor of the ninth embodiment includes the discharge port 23*b*, the discharge reed valve 29*a*, a recessed groove 277, a seal surface 53*a*, an extended portion 55, a support surface 55*a*, and communication grooves 55*b* and 55*c*. The discharge port 23*b* is an opening elongated in a direction orthogonal to the longitudinal direction D. Thus, the valve portion 295 of the discharge reed valve 29*a*, the recessed groove 277, and the seal surface 53*a* are formed in conformance with the discharge port 23*b*.

Figure 21:
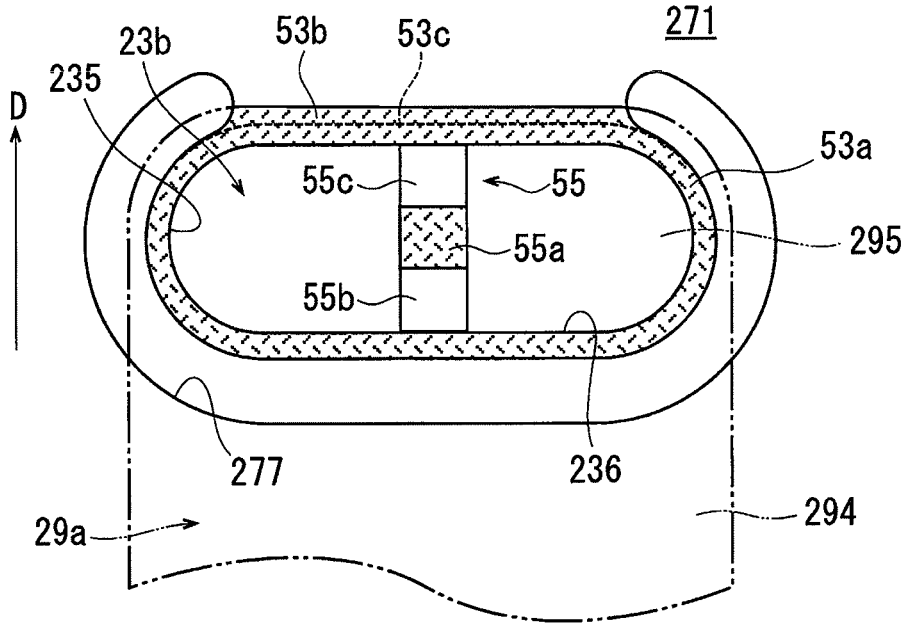
FIG. 21 is an enlarged plan view showing the valve plate of FIG. 20.

The recessed groove 277 is C-shaped in conformance with the discharge port 23*b*. A receiving surface 53*b*, which is elongated in the direction orthogonal to the longitudinal direction D, is formed in the valve plate 27. The support surface 55*a* is flush with the fixing surface 271. In FIG. 21, the boundary of the seal surface 53*a* and the receiving surface 53*b* is indicated by a line segment 53*c* shown in the pattern area. However, the seal surface 53*a* and the receiving surface 53*b* are continuous.

Further, the valve plate 27 includes the extended portion 55 that extends in the longitudinal direction to divide the discharge port 23*b* into two. The support surface 55*a* is formed at the middle the extended portion 55 on the surface facing the valve portion 295. The communication grooves 55*b* and 55*c* are formed at forward and rearward sides of the support surface 55*a* in the extended portion 55. The communication grooves 55*b* and 55*c* are arranged in the fixing surface 271 to communicate the port segments 235 and 236 when the valve portion 295 closes. Otherwise, the structure is the same as the first embodiment.

This compressor has the same advantages as the first embodiment.

It should be apparent to those skilled in the art that the present invention may be embodied in many other specific forms without departing from the spirit or scope of the invention. Particularly, it should be understood that the present invention may be embodied in the following forms.

When viewing the valve plate 27 from above, the discharge port 23*b* may have a triangular or tetragonal shape. The extended portions 272, 69, 45, 47, 49, and 55 of the above embodiments may be formed in discharge ports 23*b* having an oblong shape, a triangular shape, a tetragonal shape, or the like. Further, the support surfaces 27*d*, 42*a*, 45*a*, 47*a*, 49*a*, 51*a*, 51*b*, 45*d*, 47*d*, and 55*a* of the above embodiments may be formed in discharge ports 23*b* having an oblong shape, a triangular shape, a tetragonal shape, or the like.

The present examples and embodiments are to be considered as illustrative and not restrictive, and the invention is not to be limited to the details given herein, but may be modified within the scope and equivalence of the appended claims.

What is claimed is:

1. A compressor comprising:

a discharge chamber;

a compression chamber;

a valve plate arranged between the discharge chamber and the compression chamber, wherein the valve plate includes a fixing surface, which is exposed to the discharge chamber, and a discharge port, which communicates the discharge chamber and the compression chamber; and an elastically deformable discharge reed valve including a fixed portion, which is fixed to the fixing surface in contact with the fixing surface, a base portion, which extends in a longitudinal direction of the discharge reed valve from the fixed portion and is separable from the valve plate, and a valve portion, which further extends in the longitudinal direction from the base portion to open and close the discharge port, wherein the valve portion has a distal region including an edge at a distal end in the longitudinal direction, and the valve plate includes an annular seal surface that is flush with the fixing surface and can come into contact with the valve portion around the discharge port, a recessed groove located outward from the seal surface and arranged in the fixing surface, wherein the recessed groove includes a bottom separated from the edge of the valve portion, a receiving surface that is flush with the fixing surface and comes into contact with the distal region, and an extended portion that extends from the receiving surface toward the center of the discharge port, wherein the extended portion is continuous with the seal surface and flush with the fixing surface, wherein:

the extended portion includes a support surface that comes into contact with a central region of the valve portion; and one of a communication groove arranged in the support surface and that comes into communication with the discharge port when the discharge port is closed, and a recessed portion arranged in the support surface and that does not come into communication with the discharge port when the discharge reed valve is closed.

2. The compressor according to claim 1, wherein the valve plate includes the extended portion that extends to divide the discharge port into two, and the support surface is arranged on the extended portion.

3. The compressor according to claim 2, wherein the extended portion extends in a direction orthogonal to the longitudinal direction and divides the discharge port into two in the longitudinal direction.

4. The compressor according to claim 1, wherein the support surface faces the valve portion.

5. The compressor according to claim 1, wherein the seal surface and the receiving surface are continuous.

6. The compressor according to claim 5, wherein the recessed groove is C-shaped and includes two ends, and the seal surface and the receiving surface are continuous in a region between the two ends of the recessed groove.

7. The compressor according to claim 6, wherein the fixing surface includes an elongated groove, and when the discharge reed valve is viewed from above in a state closing the discharge port, the elongated groove is located at a basal side of the discharge port in the longitudinal direction and extends across the base portion.

8. The compressor according to claim 7, wherein the discharge port is formed through a punching process, and the recessed groove, the communication groove, and the elongated groove are formed through a stamping process.

* * * * *